US006029677A

United States Patent [19]

Nanba et al.

[11] Patent Number: 6,029,677

[45] Date of Patent: Feb. 29, 2000

[54] HAIR STYLING IRON

[75] Inventors: Yoshiyuki Nanba; Hisashi Kitamura; Eiji Tsuji, all of Hikone, Japan

[73] Assignee: Matsushita Electric Works, Ltd., Kadoma, Japan

[21] Appl. No.: 09/147,275

[22] PCT Filed: Mar. 31, 1998

[86] PCT No.: PCT/JP98/01459

§ 371 Date: Nov. 18, 1998

§ 102(e) Date: Nov. 18, 1998

[87] PCT Pub. No.: WO98/43510

PCT Pub. Date: Oct. 8, 1998

[30] Foreign Application Priority Data

Mar. 31, 1997 [JP] Japan ..... 9-081400

[51] Int. Cl.[7] ..... A45D 2/40

[52] U.S. Cl. ..... 132/225; 132/228; 132/272

[58] Field of Search ..... 132/224, 225, 132/227, 228, 232, 272

[56] References Cited

U.S. PATENT DOCUMENTS

| | | | |
|---|---|---|---|
| 1,656,142 | 1/1928 | Cocroft | 132/225 |
| 3,835,292 | 9/1974 | Walter et al. | 132/232 |
| 3,918,465 | 11/1975 | Barradas | 132/232 |
| 3,937,232 | 2/1976 | Tomaro | 132/272 |
| 4,209,685 | 6/1980 | Walter et al. | 132/232 |
| 4,936,027 | 6/1990 | Tsuji . | |
| 5,223,694 | 6/1993 | Tsuji et al. . | |
| 5,494,058 | 2/1996 | Chan . | |
| 5,660,191 | 8/1997 | Bontoux et al. | 132/228 |

FOREIGN PATENT DOCUMENTS

| | | | |
|---|---|---|---|
| 1120816 | 3/1982 | Canada | 132/227 |
| 4-1844 | 1/1992 | Japan . | |

*Primary Examiner*—Todd E. Manahan
*Attorney, Agent, or Firm*—Nikaido, Marmelstein, Murray & Oram, LLP

[57] ABSTRACT

A hair styling iron having an elongated barrel having a front end and a rear end, the barrel including a heat plate with a corrugated surface composed of a plurality of concavities and convexities arranged along a direction transverse to the length of the barrel and extending along the length of the barrel, the heat plate formed with a plurality of steam vents; a hand grip extending from the rear end of the barrel; a heater mounted in the barrel to heat the heat plate; a steam generator incorporated in the barrel to generate steam which is discharged from the steam vents; and a hair clamping member pivoted at a connection between the barrel and the hand grip for pivotal movement between a closed position of mating with the heat plate and an open position disengaged from the heat plate. The steam vents are provided exclusively at the bottom of the concavities between the convexities and are covered by the hair clamping member, the concavities being closed at a lengthwise end of the heat plate adjacent to the front end of the barrel with a leakage stopper for preventing leakage of the steam outwardly of the heat plate towards the front end of the barrel.

9 Claims, 8 Drawing Sheets

HAIR STYLING IRON

TECHNICAL FIELDS

The present invention is directed to a hair styling iron for curling hairs by means of corrugated heat plate and steam.

BACKGROUND ART

Japanese Laid-open utility model publication No. 4-1844 proposes a hair styling iron for curling hairs between a corrugated heat plate and a clamping member. In order to facilitate the hair curling, the device includes a steam generator to apply steam to the hairs through steam vents formed in the heat plate. In this prior device, however, since the steam vents are distributed over various portions including convexities and concavities of the corrugated heat plate, the steam spouting from the convexities, particularly those located at the lateral ends of the corrugated heat plate, is likely to deflect sideward, increasing the danger of touching the skin of the user and burring a skin of the user. Since the hair clamping member is connected to the barrel for pivotal movement between a closed position and an open position, the user is normally required to hold the ends of the hair clamping member and the barrel by the fingers to keeping the hair clamping member pressed tightly against the barrel with the hairs being clamped therebetween. In this condition, there certainly exists a danger of exposing the finger of the user holding the ends of the barrel and the hair clamping member to the steam which is spouted from the vents and guided along the length of the concavities towards the front end of the barrel, thereby hampering and even jeopardizing the hair styling operation.

DISCLOSURE OF THE INVENTION

The present invention has been accomplished in order to eliminate the above problem and has a primary object of providing a hair styling iron which is capable of preventing the steam from contacting the fingers of a user for enhanced safety and operational convenience.

The hair styling iron in accordance with the present invention includes an elongated barrel with a heat plate which has a corrugated surface composed of a plurality of concavities and convexities arranged along a direction transverse to the length of the barrel and extending along the length of the barrel. The heat plate is heated by a heater mounted in the barrel and is provided with a plurality of steam vents. A steam generator is provided to generate steam for discharging the steam from the steam vents. Also included is a hair clamping member which is connected to the barrel for pivotal movement between a closed position of mating with the heat plate and an open position of disengaging from the heat plate. The steam vents are provided exclusively in the concavities between the convexities. The concavities are closed at a lengthwise end of the heat plate adjacent to the front end of the barrel with a leakage stopper for preventing leakage of the stem outwardly of the heat plate towards the front end of the barrel where fingers of the user hold the hair clamping member pressed against the barrel. With this arrangement, the steam can be well prevented from diverting towards unintended portions to thereby assure a safe and convenient hair styling operation.

Preferably, the barrel and the hair clamping member are formed at their front ends, respectively, with first and second finger catches adapted to be engaged with fingers of a user. These finger catches are cooperative to facilitate the user to keep pressing the hair clamp member tightly against the heat plate with hairs being clamped therebetween.

A water tank may be provided at the front end of the barrel adjacent the first and second finger catches to be actuated by a finger of the user. The water tank is capable of being pushed-in against a spring bias to an operative position of feeding water to the steam generator for generation of the steam. Thus, the user can be easy to generate the steam simply by pushing in the water tank with one finger of the hand, while keeping the hair clamping member pressed against the barrel by the other fingers of the same hand.

Preferably, the steam vents are distributed along the length of the barrel at a portion offset towards the rear end of the barrel in order to reduce a possibility of proceeding the steam towards the front end of the barrel.

Further, the barrel may be configured to have a steam chamber which extends along a direction transverse to the length of the barrel for accumulating the steam fed from the steam generator prior to spouting the steam through the steam vents. A group of the steam vents arranged along a direction transverse to the length of the barrel are configured to extend from the steam chamber radially outwardly to the convexities, in order to spout the steam uniformly.

The hair clamping member may be formed with a knob which comes into engagement with the water tank to move it to the operative position in response to the hair clamping member being closed tightly against the heat plate. This arrangement enables the user to generate the steam simply by pressing the hair clamping member against the heat plate without requiring an additional operation of pushing the water tank.

The heat plate is preferred to be integrally formed with the barrel to form a single unit with enhanced thermal efficiency.

These and still other objects and advantages features of the present invention will become apparent from the following description of the embodiments.

MODES FOR CARRYING OUT THE INVENTION

First Embodiment FIGS. 1 to 8

Figure 1:
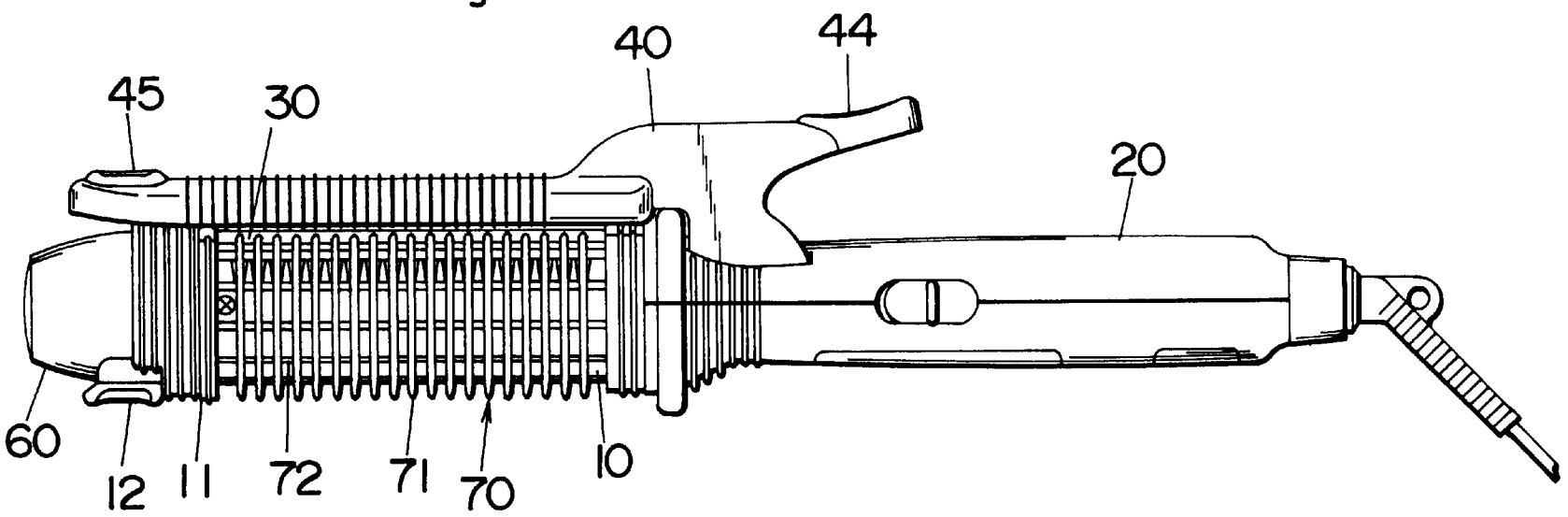
FIG. 1 is a front view of a hair styling iron in accordance with a preferred embodiment of the present invention.
Figure 2:
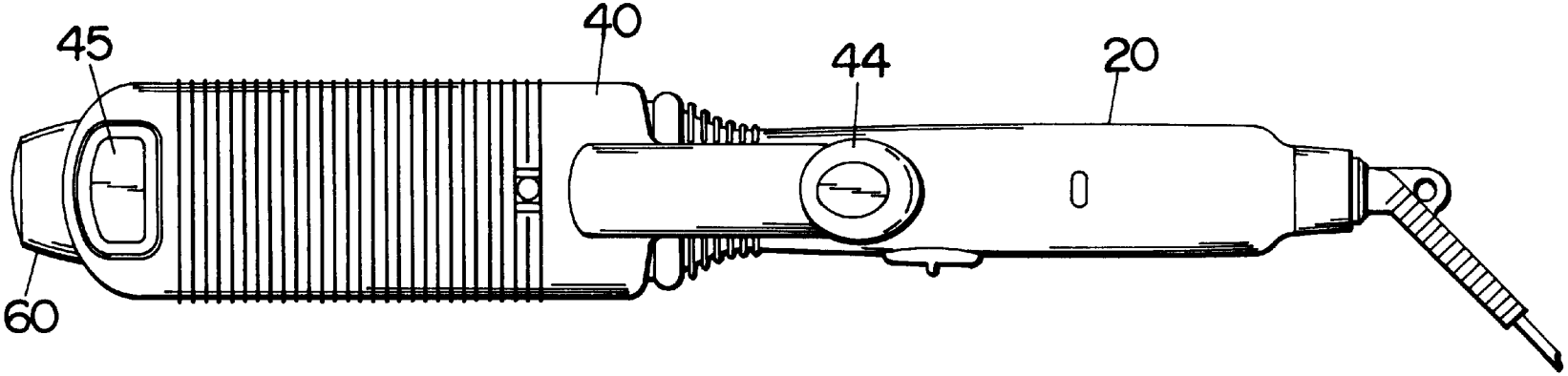
FIG. 2 is a top view of the above hair styling iron.
Figure 3:
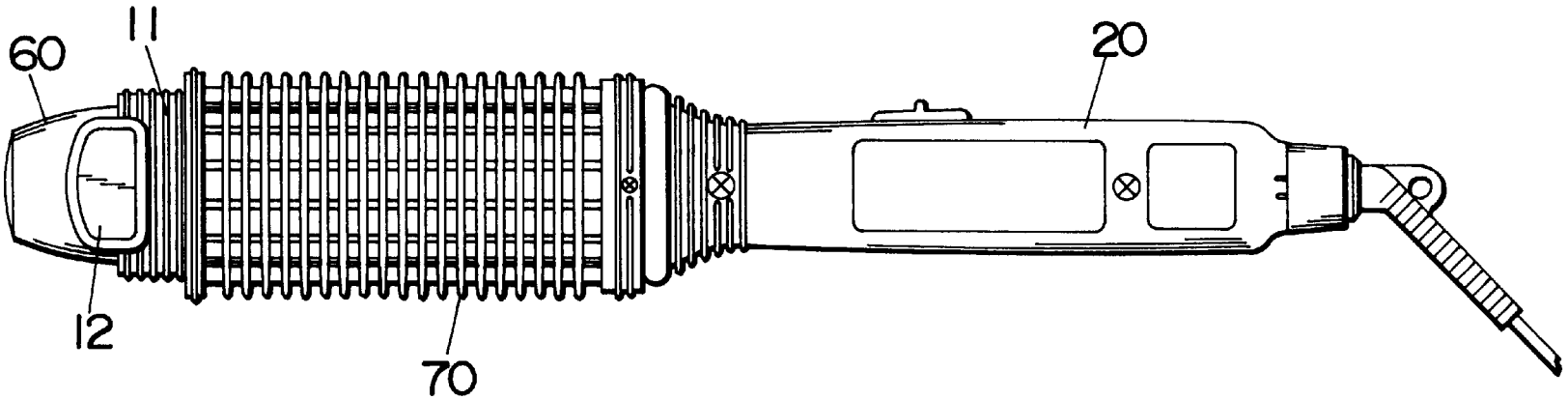
FIG. 3 is a bottom view of the above hair styling iron.
Figure 4:
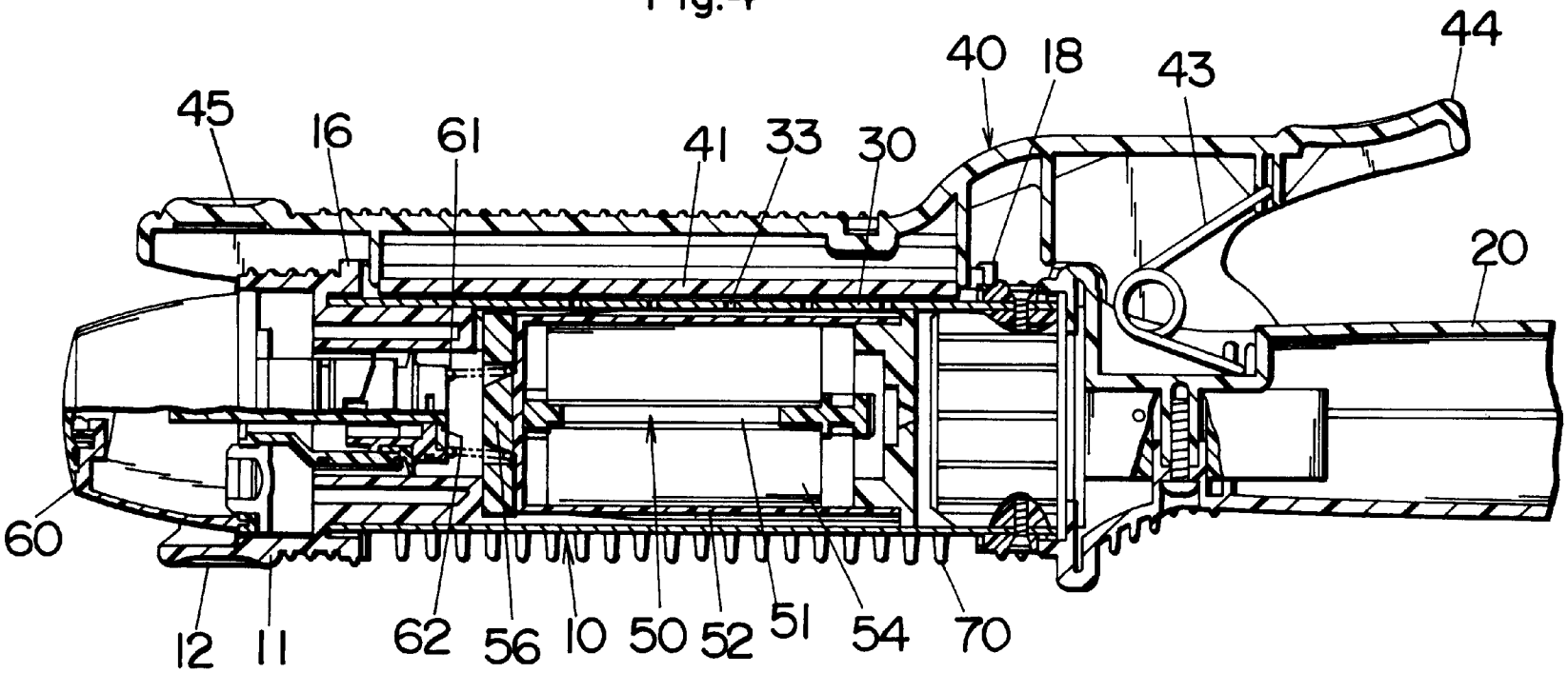
FIG. 4 is a longitudinal sectional view of the hair styling iron with a hair clamping member in a closed position.
Figure 5:
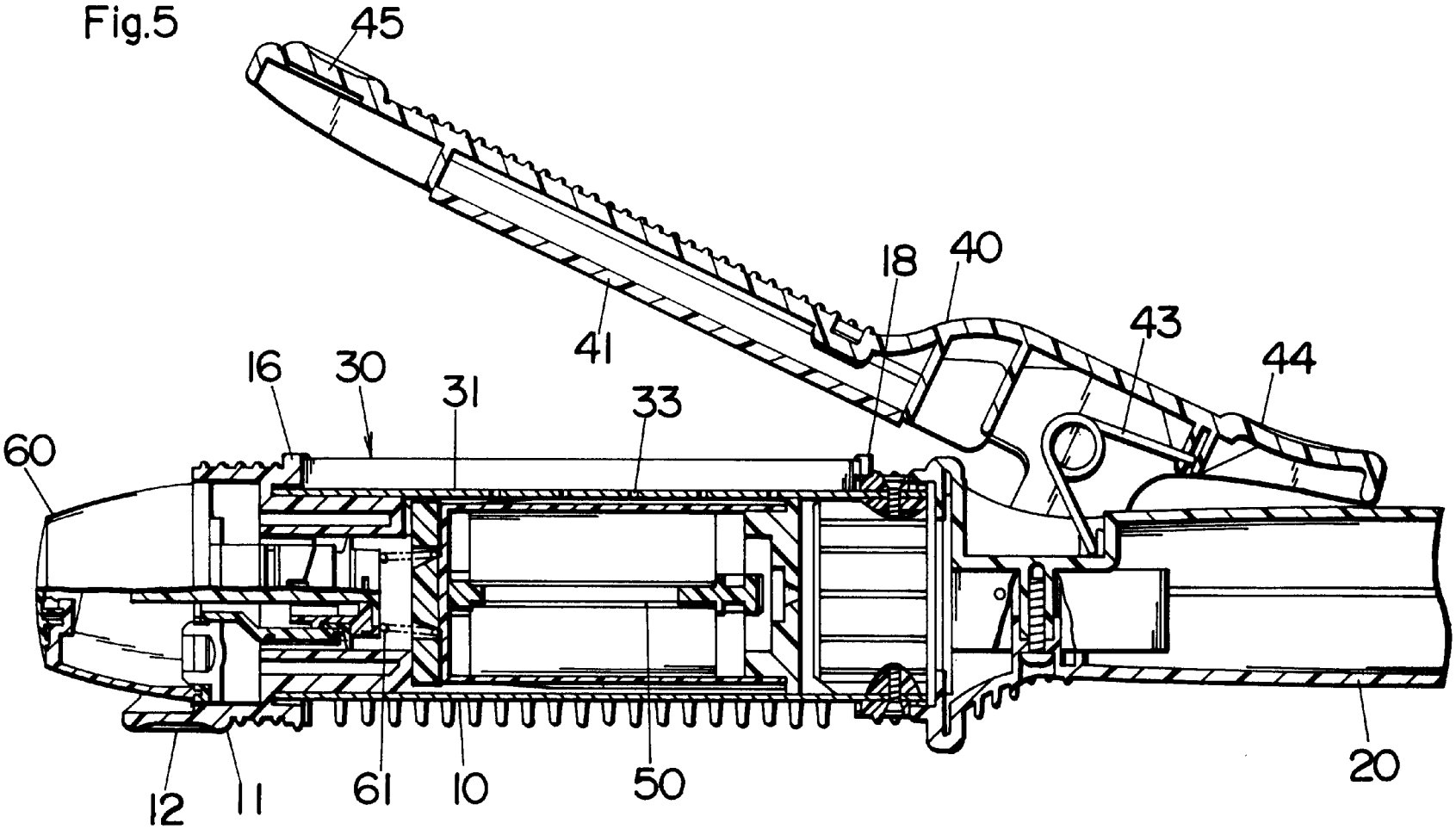
FIG. 5 is a longitudinal sectional view of the hair styling iron with a hair clamping member in an open position.
Figure 6:
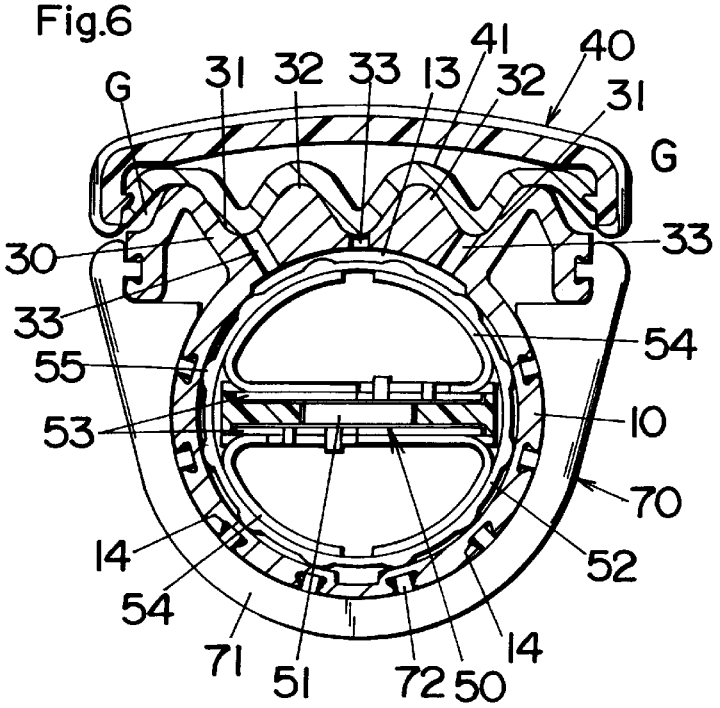
FIG. 6 is a sectional view taken along line 6—6 of FIG. 4.
Figure 7:
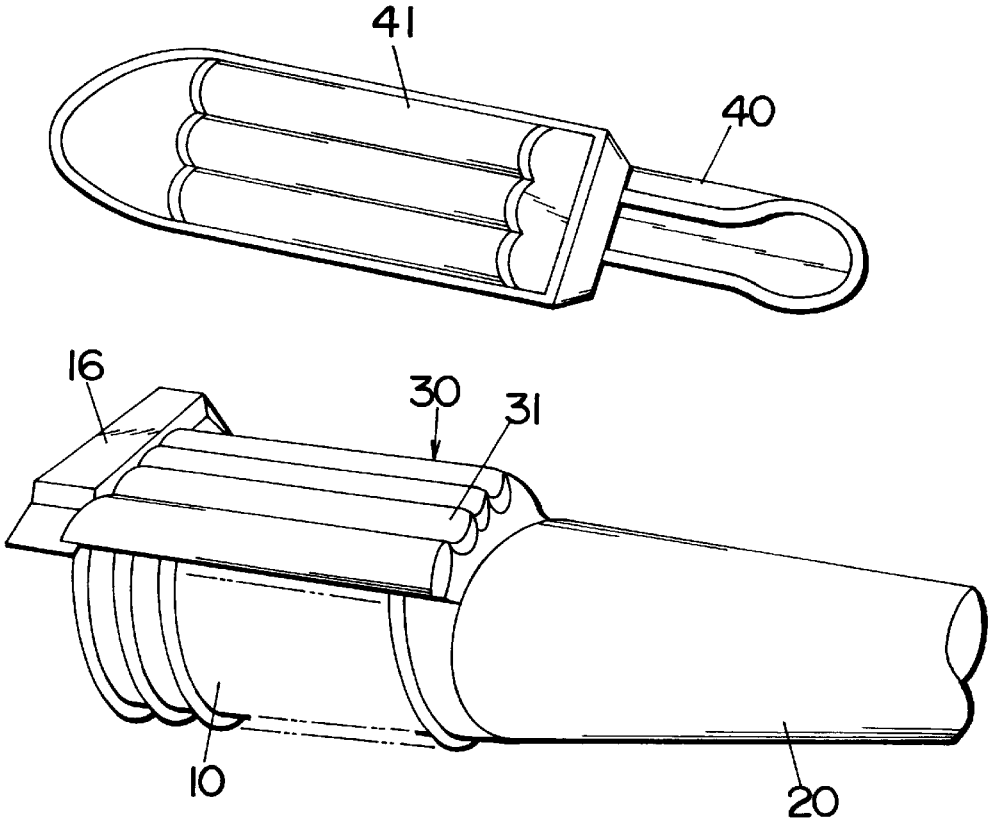
FIG. 7 is a schematic exploded perspective view of the hair styling iron.

Referring now to FIGS. 1 to 7, there is shown a hair styling iron in accordance with a first embodiment of the present invention. The hair styling iron comprises a cylindrical barrel 10 with a hand grip 20 extending axially from one longitudinal end of the barrel 10. The barrel 10 is made from a metal or plastic material of good thermal conductivity to include a corrugated heat plate 30 as an integral part of the barrel. As best shown in FIG. 6, the corrugated heat plate 30 is configured to have a plurality of concavities 31 and convexities 32 alternately arranged in a direction perpendicular to the length of the barrel 10 and extending along the length of the barrel. Each concavity 31 between the adjacent convexities 32 is formed with a plurality of steam vents 33 spaced along the length of the heat plate 30 for spouting steam therethrough.

The hair styling iron also includes a hair clamping member 40 with a corrugated press plate 41 of good thermal conductivity. The hair clamping member 40 is pivotally connected to the hand grip 20 for pivotal movement between a closed position of mating the press plate 41 with the heat plate 30 and an open position of disengaging the press plate away from the heat plate. A torsion spring 43 is provided to bias the hair clamping member 40 towards the closed position. As shown in FIG. 6, the press plate 41 is configured to leave gaps G between the lateral ends of the press plate 41 and the heat plate 30 so that the hairs entrapped between the plates can flex at these gaps and can be, therefore, prevented from being bent at the corresponding two spaced portions along the length of the hairs. The hair clamping member 40 is formed with a lever 44 at its rear end and with a finger catch 45 at its front end for engagement with a finger of the user. A complementary finger catch 12 is formed at the front end of the barrel 10 so that the user can keep the press plate 41 pressed tightly against the heat plate 30 in order to clamp the hairs firmly therebetween by holding these finger catches 45 and 12 with the fingers of the user. The finger catch 12 is formed as a part of an end tube 11 secured to the end of the barrel 10.

Incorporated within the barrel 10 is an electric heater 50 which includes a PTC (positive temperature coefficient) heating element 51 producing heat upon being fed with electric current. As shown in FIG. 6, the heating element 51 is enclosed within a metal cylindrical sheath 52 together with a pair of electrodes, a pair of alumina-made electrically insulating plates 53 and a pair of semi-circular heat sinks 54. The sheath 52 is formed on its exterior with a plurality of circumferentially spaced protrusions 55 which come into pressed contacts with the interior of the barrel 10 for heating the heat plate 30 by the heater. The sheath 52 is formed on its closed longitudinal end with a heat header 56 for generation of steam by contact with water.

Figure 8:
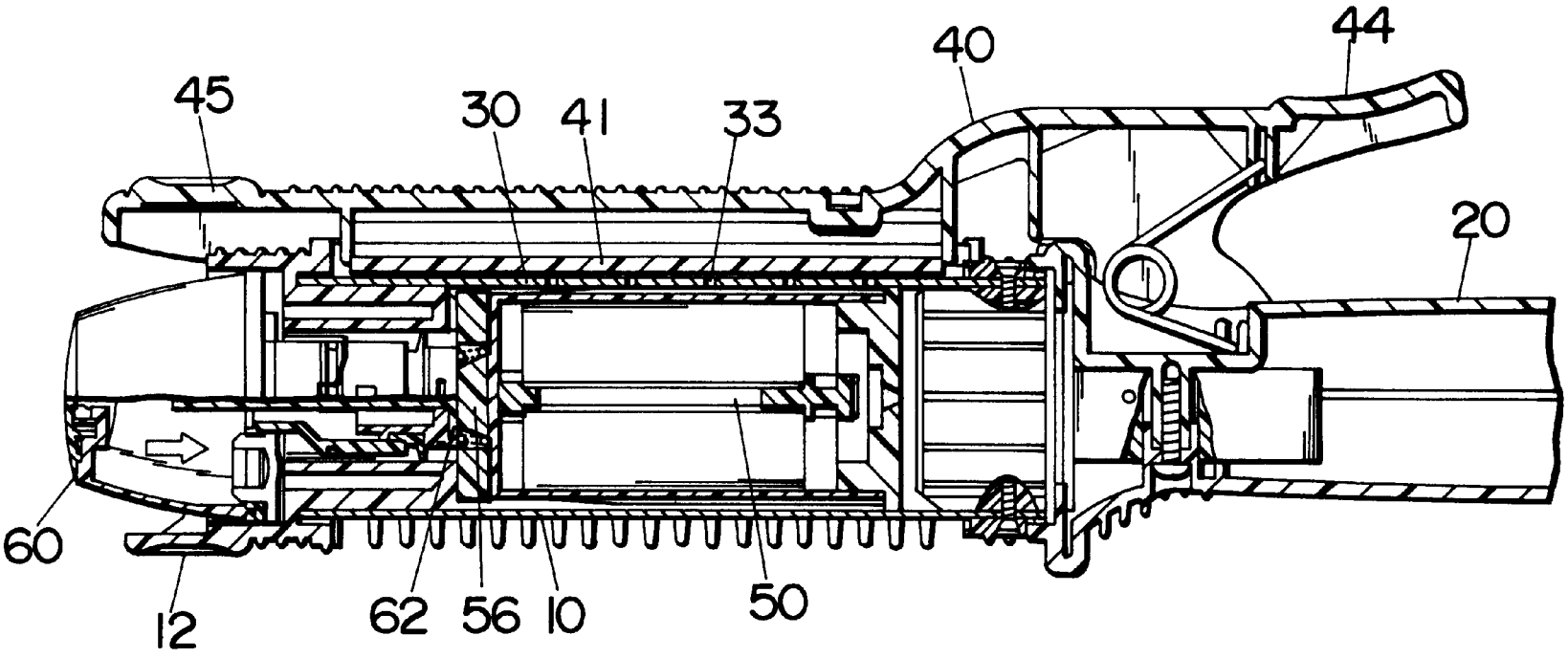
FIG. 8 is a sectional view similar to FIG. 4 but illustrating a water tank being pushed in for generation of steam.

Formed at the front end of the barrel 10 is a water tank 60 which is slidably held by the end tube 11 to be capable of being pushed inwardly of the barrel 10 against a coil spring 61. The water tank 60 can be pushed in by an index finger of the hand of a user, while the hair clamping member 40 is kept pressed against the barrel by other fingers, such as thumb and middle fingers of the same hand. A wick 62 carrying water extends from the water tank 60 towards the heat header 56 in an abuttable relation thereto. The wick 62 is cooperative with the heat header 56 to define a steam generator for generation of the steam. In operation, when the water tank 60 is pushed-in to abut the wick 62 against the heat header 56, as shown in FIG. 8, the water conveyed by the wick is heated into the steam which is then guided into a chamber 13 formed between the heat plate 30 and the sheath 52, as shown in FIG. 6, and is accumulated therein prior to being discharged through the steam vents 33. As shown in FIG. 6, the chamber 13 extends along a circumferential portion of the barrel and communicates with the steam vents 33. A group of the steam vents 33 appearing in a plane transverse to the length of the barrel 10 are configured to extend radially outwardly from the chamber 13 so as to allow the steam to escape uniformly through the steam vents.

Formed at the front end of the barrel 10 is a leakage stopper 16 which is integrally molded from the end tube 11 to project at a position immediately forwardly of the heat plate 30 for closing the front open ends of the concavities 31, as shown in FIG. 8, thereby blocking the steam from escaping towards the front end of the barrel 10 where the fingers of the user are engaged with the first and second finger catches 12 and 45 for holding the hair clamping member 40 pressed against the heat plate 30. Thus, the user can use the hair styling curler without exposing the fingers to the steam during the hair styling operation. The leakage stopper 16 may be formed on the side of the hair clamping member 40. The rear end of the heat plate 30 is fitted with an end cap 18 of a plastic material which closes at least a portion of the rear open end of each concavities 31.

The steam vents 33 are distributed along the length of the concavities at a position offset towards the rear end of the barrel 10 so as to reduce the amount of the steam propagating towards the front end of the barrel. Otherwise, the steam would be likely to propagate towards the front end of the barrel 10 where the gap distance between the heat plate 30 and the press plate 41 is made greater than at the rear the rear end thereof due to the pivotal connection of the hair clamping member 40 and the barrel 10.

The barrel 10 is fitted at a portion other than the heat plate 30 with a plastic guard 70 of poor thermal conductivity for preventing accidental contact of the heated barrel with the hands of the user. The guard 70 is in the form of a lattice composed of a plurality of longitudinally spaced rings 71 integrally connected by a plurality of circumferentially spaced longitudinal ribs 72, and is secured to the barrel 10 by engaging the ribs 72 into grooves 14 in the outer surface of the barrel 10.

Figure 9:
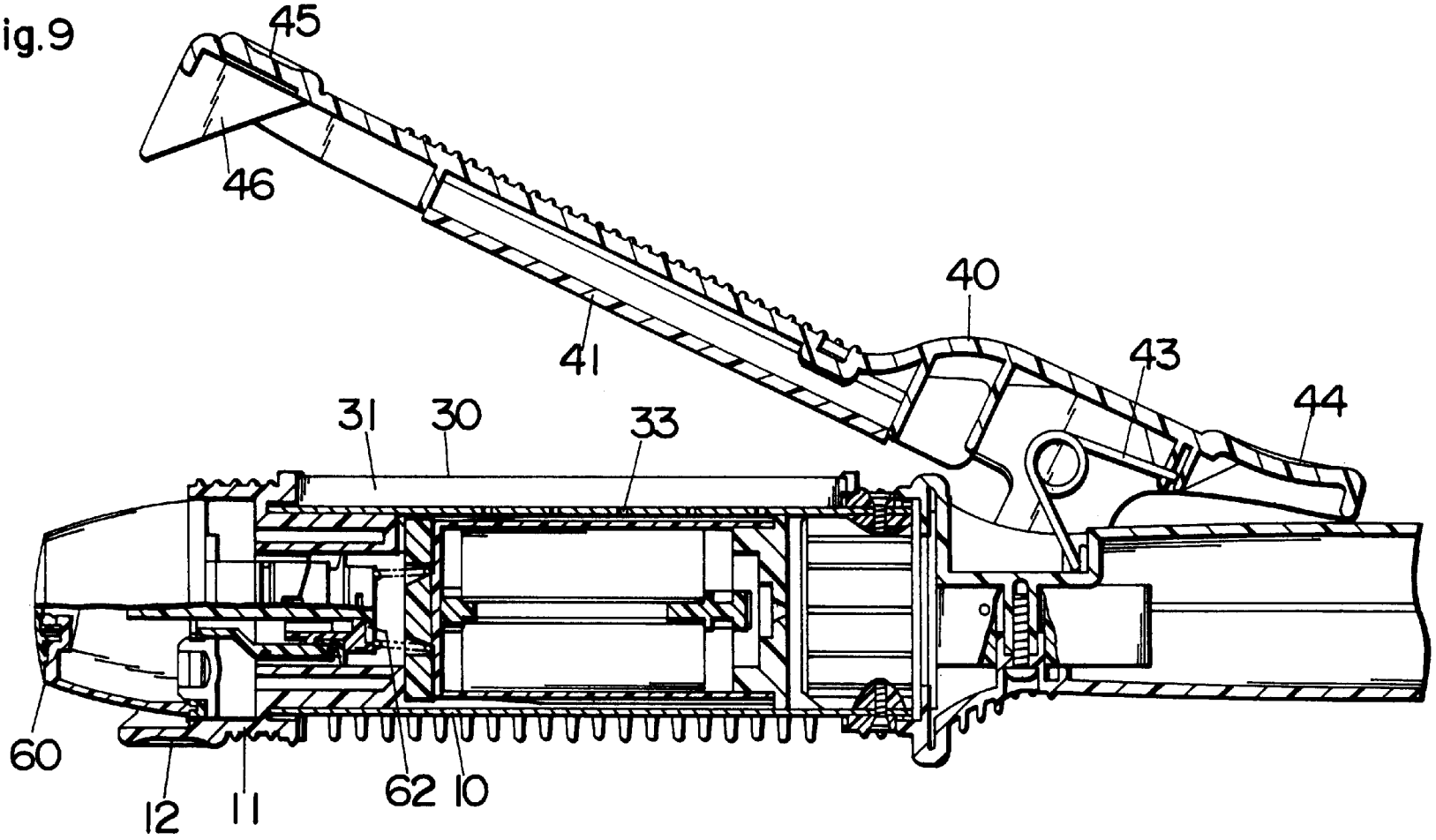
FIG. 9 is a longitudinal sectional view of the hair styling iron in accordance with a second embodiment of the present invention, shown with a hair clamping member in an open position.
Figure 10:
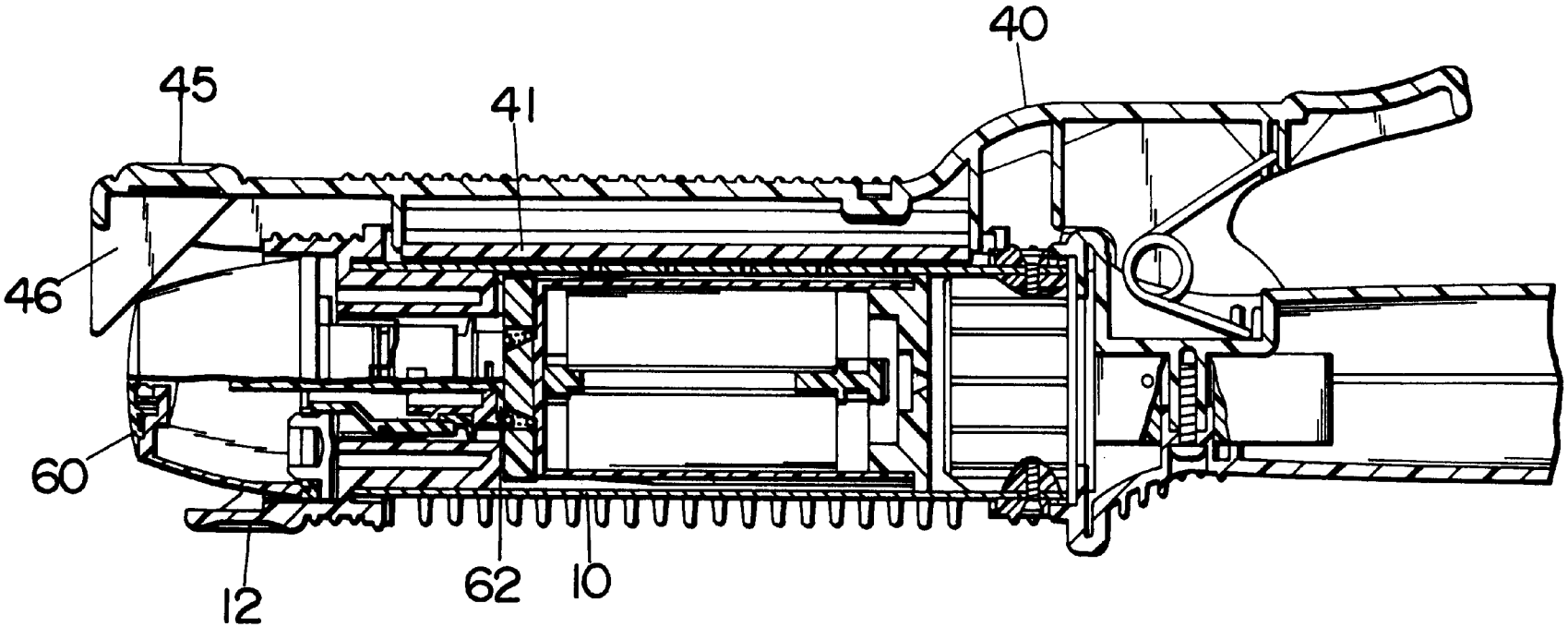
FIG. 10 is a longitudinal sectional view of the hair styling iron with a hair clamping member in a closed position.

Second Embodiment FIGS. 9 and 10

FIGS. 9 and 10 shows a hair styling iron in accordance with a second embodiment of the present invention which is identical to the first embodiment except for a wedge knob 46 formed at the front end of the hair clamping member 40. Like parts are designated by like numerals as in the first embodiment. The wedge knob 46 is configured to comes into engagement with the tip of the water tank 60 when the hair clamping member 40 is pressed against the barrel 10, thereby pushing in the water tank 60 to the operative position of generating the steam. Thus, the steam can be generated during the hair styling operation simply by pressing the hair clamping member against the barrel.

This application is based upon and claims the priority of Japanese Patent Application No. 9-81400, filed in Japan on Mar. 31, 1997, the entire contents of which are expressly incorporated by reference herein.

What is claimed is:

1. A hair styling iron comprising:

an elongated barrel having a front end and a rear end, said barrel including a heat plate with a corrugated surface composed of a plurality of concavities and convexities arranged along a direction transverse to the length of said barrel and extending along the length of said barrel, said heat plate formed with a plurality of steam vents;

a hand grip extending from said rear end of said barrel;

a heater mounted in said barrel to heat said heat plate;

a steam generator incorporated in said barrel to generate steam which is discharged from the steam vents; and a hair clamping member pivoted at a connection between said barrel and said hand grip for pivotal movement between a closed position of mating with said heat plate and an open position disengaged from said heat plate;

wherein said steam vents are provided exclusively at the bottom of said concavities between said convexities and are covered by said hair clamping member, said concavities being closed at a lengthwise end of said heat plate adjacent to said front end of said barrel with a leakage stopper for preventing leakage of said steam outwardly of said heat plate towards the front end of said barrel.

2. The hair styling iron as set forth in claim 1, wherein said barrel is formed at its front end with a first finger catch adapted to be engaged by a finger of a user, said hair clamping member being formed at its longitudinal end adjacent the front end of said barrel with a second finger catch adapted to be engaged by another finger of the user, said first and second finger catches being cooperative to facilitate the user to press the hair clamp member tightly against said heat plate with a bundle of hairs clamped therebetween.

3. The hair styling iron as set forth in claim 2, wherein a water tank is provided at said front end of said barrel adjacent said first and second finger catches so as to be actuated by a finger of the user, said water tank being capable of being pushed-in against a spring bias to an operative position of feeding water to said steam generator for generation of the steam.

4. The hair styling iron as set forth in claim 3, wherein said hair clamping member is provided with a knob which comes into engagement with said water tank to move said water tank to said operative position when said hair clamping member is closed tightly against said heat plate.

5. The hair styling iron as set forth in claim 1, wherein said barrel has a steam chamber which extends along a direction transverse to the length of said barrel for accumulating said steam fed from said steam generator, said steam vents arranged along said direction transverse to the length of said barrel being configured to extend from said steam chamber radially outwardly to said convexities.

6. The hair styling iron as set forth in claim 1, wherein said steam vents are distributed along the length of said barrel at a position offset towards the rear end of said barrel.

7. The hair styling iron as set forth in claim 1, wherein said heat plate is integrally form with said barrel to form a single unit.

8. A hair styling iron comprising:

an elongated barrel having a front end and a rear end, said barrel including a heat plate with a corrugated surface composed of a plurality of concavities and convexities arranged along a direction transverse to the length of said barrel and extending along the length of said barrel, said heat plate formed with a plurality of steam vents;

a hand grip extending from said rear end of said barrel;

a heater mounted in said barrel to heat said heat plate;

a steam generator incorporated in said barrel to generate steam which is discharged from the steam vents; and a hair clamping member pivoted at a connection between said barrel and said hand grip for pivotal movement between a closed position of mating with said heat plate and an open position disengaged from said heat plate;

wherein said steam vents are provided exclusively in said concavities between said convexities, said concavities being closed at a lengthwise end of said heat plate adjacent to said front end of said barrel with a leakage stopper for preventing leakage of said steam outwardly of said heat plate towards the front end of said barrel, and wherein said steam vents are distributed along the length of said barrel at a position offset towards the rear end of said barrel.

9. A hair styling iron comprising:

an elongated barrel having a front end and a rear end, said barrel including a heat plate with a corrugated surface composed of a plurality of concavities and convexities arranged along a direction transverse to a length of said barrel and extending along the length of said barrel, said heat plate formed with a plurality of steam vents;

a hand grip extending from said rear end of said barrel;

a heater mounted in said barrel to heat said heat plate;

a steam generator incorporated in said barrel to generate steam which is discharged from the steam vents; and a hair clamping member pivoted at a connection between said barrel and said hand grip for pivotal movement between a closed position of mating with said heat plate and an open position disengaged from said heat plate;

wherein said steam vents are provided exclusively in said concavities between said convexities, said concavities being closed at a lengthwise end of said heat plate adjacent to said front end of said barrel with a leakage stopper for preventing leakage of said steam outwardly of said heat plate towards the front end of said barrel, wherein said barrel is formed at its front end with a first finger catch adapted to be engaged by a finger of a user, said hair clamping member being formed at its longitudinal end adjacent the front end of said barrel with a second finger catch adapted to be engaged by another finger of the user, said first and second finger catches being cooperative to facilitate the user to press the hair clamp member tightly against said heat plate with a bundle of hairs clamped therebetween, wherein a water tank is provided at said front end of said barrel adjacent said first and second finger catches so as to be actuated by a finger of the user, said water tank being capable of being pushed-in against a spring bias to an operative position of feeding water to said steam generator for generation of the steam, and wherein said hair clamping member is provided with a knob which comes into engagement with said water tank to move it to said operative position when said hair clamping member is closed tightly against said heat plate.

* * * * *